United States Patent [19]

Williams

[11] 4,237,614

[45] Dec. 9, 1980

[54] ADJUSTABLE LOCATOR FOR FURRING STRIPS

[76] Inventor: James R. Williams, 7195 Akron-Canfield Rd., Canfield, Ohio 44406

[21] Appl. No.: 90,672

[22] Filed: Nov. 2, 1979

[51] Int. Cl.[3] ..... B43I 13/00

[52] U.S. Cl. ..... 33/180 R; 269/43; 269/904

[58] Field of Search ..... 269/43, 44, 321 S, 315; 33/180 R, 187, 188, 174 G

[56] References Cited

U.S. PATENT DOCUMENTS

| | | | |
|---|---|---|---|
| 372,221 | 10/1887 | Hubbard et al. | 33/187 |
| 631,315 | 8/1899 | Meskill | 33/187 |
| 1,504,635 | 8/1924 | McCausland | 33/188 |
| 1,671,322 | 5/1928 | Smith | 33/187 |
| 2,256,554 | 9/1941 | Epstein | 33/180 R |
| 3,201,874 | 8/1965 | Christy | 33/180 R |

*Primary Examiner*—Robert C. Watson
*Attorney, Agent, or Firm*—Webster B. Harpman

[57] ABSTRACT

An adjustable locator for positioning furring strips on a supporting surface in desired spaced relation provides an elongated body member with a hooked end that engages a first furring strip and has a channel-shaped member in spaced relation thereto for holding a second furring strip so as to locate it on the supporting surface.

7 Claims, 3 Drawing Figures

ADJUSTABLE LOCATOR FOR FURRING STRIPS

BACKGROUND OF THE INVENTION

1. Field of the Invention:

This invention relates to spacing tools which are used to space and position furring strips on a supportive surface.

2. Description of the Prior Art:

Prior spacing devices have generally comprised brackets arranged to space elements, for example see U.S. Pat. Nos. 3,888,477, 3,718,980 and 3,183,598.

In U.S. Pat. No. 3,888,477 a spacing device is disclosed being movably adjustable in a channel, guided and secured thereto by a pair of bolts for the specific spacing of step risers on sloping terrain.

Applicant's device has no such similar construction nor could it be modified to perform such a task.

In U.S. Pat. No. 3,718,980 a device for measuring construction members is disclosed which is used to determine the size of material required to fill a given span by a transversely extending edge portion and a movable guide member.

Applicant's device discloses a U-shaped tapered end portion and a movable channel member for holding in spaced relation the next furring strip to be secured to a ceiling surface.

In U.S. Pat. No. 3,183,598 a gauge for tile cutting comprises a H-shaped gauge having an adjustable center portion.

Applicant's device does not use such a telescopic extension and relies on a movable channel member for engagement and spacing of the next furring strip to be installed.

SUMMARY OF THE INVENTION

An adjustable locator for positioning furring strips on supporting surfaces comprises an elongated body member having upturned and inturned flanges on one of its ends with a slot in the inturned flange. A longitudinally extending secondary slot is formed inwardly of the opposite end of the body member and a transverse channel shaped body member having a centrally located fastener is engaged in the secondary slot of the elongated body member so as to be adjustable with respect thereto.

By placing the locators inturned and upturned flange portion under the edge of a fixed furring strip a second strip can be located and held by the transverse body member in properly spaced relation to the first furring strip.

DESCRIPTION OF THE PREFERRED EMBODIMENT

Figure 1:
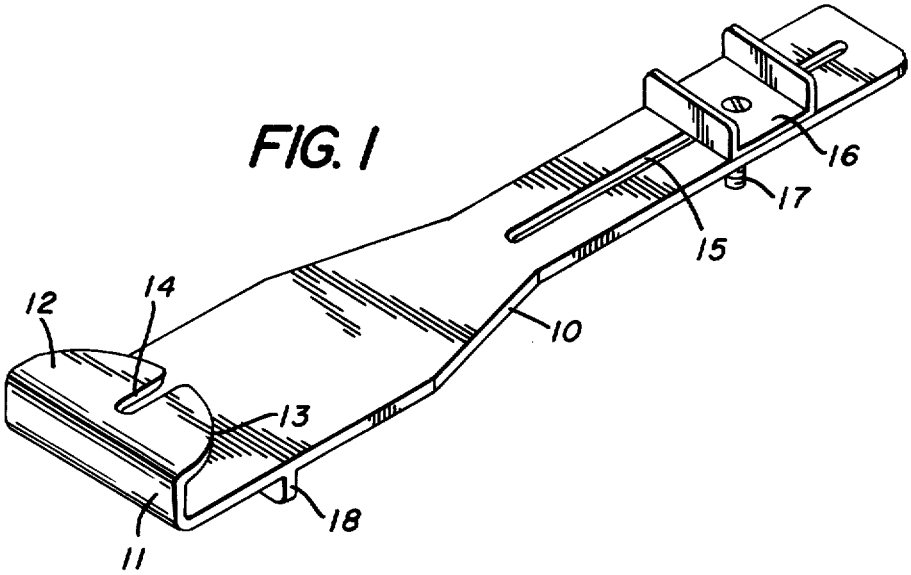
FIG. 1 is a perspective view of the adjustable locator for furring strips.

In the form of the invention chosen for illustration, an adjustable locator for positioning furring strips comprises, as will best be seen in FIG. 1 of the drawings, an elongated body member 10 having an upstanding flange 1 on one end, the flange 11 having an inturned portion 12. The inturned portion 12 is tapered as at 13 and is preferably of an arcuate shape at its inner end. A slot 14 extends from the end of the portion 12 axially across the same to a position adjacent the upstanding flange 11. An elongated secondary slot 15 is formed axially and inwardly of the opposite end of the elongated body member 10. A channel shaped body member 16 having a centrally located fastener such as a bolt and nut 17 is positioned on the elongated body member 10 with the fastener 17 positioned in the elongated secondary slot 15.

Figure 2:
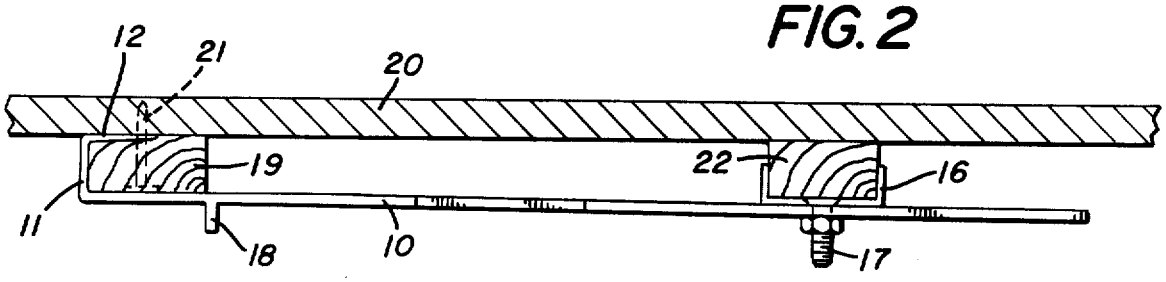
FIG. 2 is a side view showing the invention in operative position.

As shown in FIGS. 1 and 2 of the drawings, a depending flange 18 is formed on the elongated body member 10 near the flange 11 to provide a member that can be struck with a hammer to drive the inturned portion 12 into the space between a furring strip 19 and a ceiling 20, as seen in FIG. 2.

In FIG. 2 of the drawings, the adjustable locator for furring strips is shown in use with the inturned flange 12 driven under an existing furring strip 19 which is secured to a ceiling 20 with a nail 21. The slot 14 in the inturned flange 12 provides clearance for the nail 21. The channel shaped body member 16 is pre-positioned a desirable distance from the flange 11 and secured to said elongated body member 10 by the fastener 17 in such position that it aligns and spaces a secondary furring strip 22 by holding the same in desired position while the secondary furring strip is secured to the ceiling 20.

Figure 3:
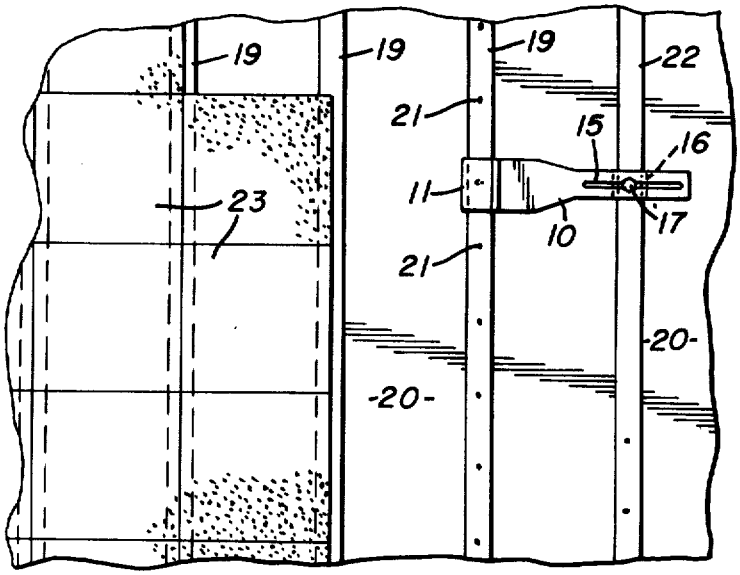
FIG. 3 is a bottom view showing the invention in operation on a typical ceiling installation.

In FIG. 3 of the drawings, a typical ceiling installation is shown wherein ceiling tiles 23 are attached to a series of furring strips 19 and the adjustable locator for furring strips 10 is shown in operative position on one of the furring strips 19 and holding said secondary furring strip 22 in spaced relation for nailing to the ceiling 20.

To disengage the furring strip locator the depending flange 18 is struck so as to move the inturned portion 12 from its position between the ceiling 20 and the furring strip 19.

It will thus be seen that an adjustable locator for furring strips has been disclosed which can easily and quickly be adjusted to the spacing required such as 12 inches so that a furring strip can be aligned and held for installation.

Although but one embodiment of the present invention has been illustrated and described, it will be apparent to those skilled in the art that various changes and modifications may be made therein without departing from the spirit of the invention and having thus described my invention what I claim is:

1. An adjustable locator for positioning furring strips comprises an elongated straight body member, a right angular upturned portion on one end thereof, a right angular inturned portion on said upturned portion, said inturned portion being spaced with respect to and parallel with a part of said elongated straight body member, a channel-shaped body member slidably positioned on said elongated straight body member and means for detachably securing said channel shaped body member to said elongated straight body in a desired location thereon spaced with respect to said upturned and inturned end portions.

2. The adjustable locator for positioning furring strips of claim 1 wherein the inturned portion is tapered and wherein said inturned portion has an elongated slot axially thereof.

3. The adjustable locator for positioning furring strips of claim 1 wherein said elongated straight body member is of a generally flat rectangular configuration.

4. The adjustable locator for positioning furring strips of claim 1 wherein said means for detachably securing said channel shaped body member to said elongated body member comprises a fastener in said channel shaped body member engaging a longitudinal extending slot in said elongated straight body member.

5. The adjustable locator for positioning furring strips of claim 1 wherein the channel shaped body member is of a width slightly larger than the width of said one of said furring strips.

6. The adjustable locator for positioning furring strips of claim 1 wherein said channel shaped body member is positioned transversely of the axis of said elongated straight body member.

7. The adjustable locator for positioning furring strips of claim 1 wherein said channel shaped member has a flat base portion and upstanding flanges on its opposite edges and wherein said flanges are of a height less than the height of one of said furring strips.

* * * * *